US005210583A

United States Patent [19]

Monma

[11] Patent Number: 5,210,583

[45] Date of Patent: May 11, 1993

[54] ELECTROPHOTOGRAPHIC PRINTER WHICH POSITIONS THE LEADING EDGE OF A RECORDING SHEET

[75] Inventor: Yoshio Monma, Saitama, Japan

[73] Assignee: Asahi, Kogaku, Kogyo, Kabushiki, Kaisha, Tokyo, Japan

[21] Appl. No.: 700,323

[22] Filed: May 9, 1991

Related U.S. Application Data

[63] Continuation of Ser. No. 563,200, Aug. 6, 1990, abandoned.

[30] Foreign Application Priority Data

Aug. 8, 1989 [JP] Japan ..... 1-93157[U]

[51] Int. Cl.[5] ..... G03G 21/00

[52] U.S. Cl. ..... 355/309; 226/112; 355/317

[58] Field of Search ..... 355/308, 309, 311, 316, 355/317, 321, 271, 282, 208; 226/10, 27, 33, 43, 45, 28, 91, 108, 112, 172; 271/4, 152, 153, 258, 265

[56] References Cited

U.S. PATENT DOCUMENTS

| | | | |
|---|---|---|---|
| 4,377,333 | 3/1983 | Tsuji et al. | 355/309 |
| 4,478,508 | 10/1984 | Kato et al. | 355/317 |
| 4,843,429 | 6/1989 | Avritt et al. | 355/317 X |
| 4,924,266 | 5/1990 | Negoro et al. | 355/308 X |
| 4,943,863 | 7/1990 | Ainoya | 355/271 |
| 4,949,104 | 8/1990 | Negoro et al. | 355/316 X |
| 4,987,448 | 1/1991 | Chikama | 355/316 X |
| 5,019,872 | 5/1991 | Zajac, Jr. | 355/317 |
| 5,061,967 | 10/1991 | Isobe | 355/271 X |

FOREIGN PATENT DOCUMENTS

| | | | |
|---|---|---|---|
| 3811413 | 10/1988 | Fed. Rep. of Germany . | |
| 0089439 | 8/1978 | Japan | 355/309 |
| 0083931 | 5/1985 | Japan | 355/308 |
| 62-233276 | 10/1987 | Japan . | |

*Primary Examiner*—A. T. Grimley
*Assistant Examiner*—William J. Royer
*Attorney, Agent, or Firm*—Sandler, Greenblum & Bernstein

[57] ABSTRACT

In a printing device such as a laser beam printer utilizing a continuous-form recording sheet, a forming member is provided for forming an image on a continuous-form recording sheet. A feeding mechanism feeds the continuous-form recording sheet along a predetermined feeding path, and a fixing mechanism fixes the image onto the continuous-form recording sheet. A detecting device, located at the upstream side of the fixing member along the predetermined feeding path, detects a leading edge of the continuous-form recording sheet, and a controlling device controls the feeding member so as not to feed the continuous-form recording sheet when the leading edge of the continuous-form recording sheet is detected by the detecting member. Thus, it becomes possible to prevent more than one page of recording sheet from being wasted.

23 Claims, 5 Drawing Sheets

ELECTROPHOTOGRAPHIC PRINTER WHICH POSITIONS THE LEADING EDGE OF A RECORDING SHEET

This application is a continuation of application Ser. No. 07/563,200, filed Aug. 6, 1990, now abandoned.

BACKGROUND OF THE INVENTION

The present invention relates to a printer for forming an image on a continuous-form recording sheet using an electrophotographic method.

Image forming apparatuses using a so-called electrophotographic method such electronic copying machines, have been known in which an electrostatic latent image is formed by exposing a photoreceptor on the surface of a charged photoconductive drum toner is adhered to the latent image for development, transferred to a recording sheet arranged to be synchronously fed with the photoconductive drum and fixed by a fixing unit.

One of these known machines includes a laser beam printer arranged so as to obtain a hard copy of image information by scanning and exposing a charged photoconductive drum by laser beams modulated, in accordance with the image to be developed including figures, characters and the like, using the copy process of the above mentioned electrophotographic method.

The laser beam printer is very useful, because it can be widely used in such a manner that it draws figures of information received by an image reading unit, such as an image scanner. Further, it may be used as an output terminal of a facsimile, and it outputs information at a high speed.

In general, such a laser beam printer is arranged based upon a conventional well-known electronic copying machine, and employs so-called cut-type sheets cut into a predetermined size as a recording medium on which the desired image is formed. A so-called heat roller type fixing unit comprises a pair of fixing rollers composed of a heat roller arranged to be heated with high temperatures and a backup roller arranged to be brought into contact with the heat roller at a predetermined pressure force. The recording medium, upon which an unfixed toner image corresponding to the image information is formed, is caused to pass between the rollers so that it is heated and pressed, whereby the toner is melted and adhered to the recording medium. The desired image is thus formed and fixed on the surface of the recording medium.

In the electrophotographic method, the rotation of a photoconductive drum causes an exposed portion thereof to reach a transfer unit. The toner image is transferred onto the recording sheet, which is fed at predetermined speed identical with a peripheral speed of the photoconductive drum, at the transfer unit. Thus, in this process it is impossible to form images intermittently by interrupting the process.

Therefore, the laser beam printer is provided with a memory capable of storing image information data for at least one page, and when the image information data for one page is completely input therein, the printer outputs them every one page data.

Of course this laser beam printer can be used as an output terminal of a computer. In this case, a continuous-form sheet similar to that used in a conventional line printer is used. The continuous-form sheet, hereinafter referred to as a "continuous sheet", used in the conventional line printer is a so-called fan-folded sheet having a plurality of sprocket holes provided at both side edges at predetermined intervals along a longitudinal direction thereof. The continuous sheet is arranged to be folded along perforated tear lines to enable the sheet to be simply cut off.

When a continuous sheet is employed in a laser beam printer using a heat roll fixing system, the length of a recording sheet feed path from a transferring position of a transferring unit to a fixing position of a fixing unit must be substantially the same as the distance between the perforated tear lines of the continuous sheet. This prevents a disadvantage caused when the laser beam printer stops to feed the continuous sheet after the image forming operations are performed. A page being subjected to a fixing operation is stopped between the pair of fixing, and the unfixed toner, in the process of the fixing operation, remains caught between the pair of the fixing rollers.

More specifically, since the continuous sheet is finally cut off along the perforated tear lines for use, no image must be formed within a predetermined region in the vicinity of the perforated tear lines. Thus in a laser beam printer by which images are formed for each page, the vicinity of the tear lines where no image is formed is arranged to be stopped at the transferring position of the transferring unit. Consequently, when the length of the recording sheet feed path from the transferring position to the fixing position is set to be substantially same as the distance between the perforated tear lines of the continuous sheet, the above disadvantage can be avoided. This is because the vicinity of the tear line where no image is formed is caused to be located at the fixing position of the fixing unit where fixing action is effected wherever the laser beam printer stops to feed the continuous sheet.

In the above structured laser beam printer, a leading edge of the continuous sheet is arranged to be forwardly projected through the pair of fixing rollers by a predetermined amount when the continuous sheet is mounted on the laser beam printer. Therefore, the projected leading edge is heated by the heat roller and curled by the temperature generated by the heat roller, and then the curled sheet is wound around the heat roller. For avoiding this problem, it has been necessary to provide a pressing member for pressing the leading edge projected from the pair of fixing rollers. As a result, the position of the continuous sheet opposed to the transferring position in the transfer unit is located behind the position at which the image forming operation is to be started on the second page of the continuous sheet. In other words, the image forming operation is started from the following page, i.e., the third page. Therefore, the preceding two pages are inevitably wasted.

SUMMARY OF THE INVENTION

It is therefore an object of the invention to provide an improved printing device using continuous-form recording sheet comprising a plurality of pages, the printing device being capable of avoiding the waste of the pages.

For this purpose, according to the present invention, there is provided a printing device capable of employing at least a continuous-form recording sheet having a plurality of printing pages on which an image is to be formed. Each of the pages are designated by a plurality of transverse perforations provided on the continuous-form recording sheet at predetermined intervals of length along a longitudinal direction thereof.

The printing device is provided with forming mechanism for forming an image on the continuous-form recording sheet. A feeding mechanism is provided for feeding the continuous-form recording sheet along a predetermined feeding path, and a fixing mechanism fixes the image formed by the forming mechanism on the continuous-form recording sheet.

A detecting device is also provided at an upstream side of the fixing mechanism along the predetermined feeding path. The detecting device detects a leading edge of the continuous-form recording sheet.

A controlling device controls the feeding mechanism so as not to feed the continuous-form recording sheet when the leading edge of the continuous-form recording sheet is detected by the detecting device.

BRIEF DESCRIPTION OF THE ACCOMPANYING DRAWINGS

DETAILED DESCRIPTION OF THE PREFERRED EMBODIMENTS

Figure 1A:
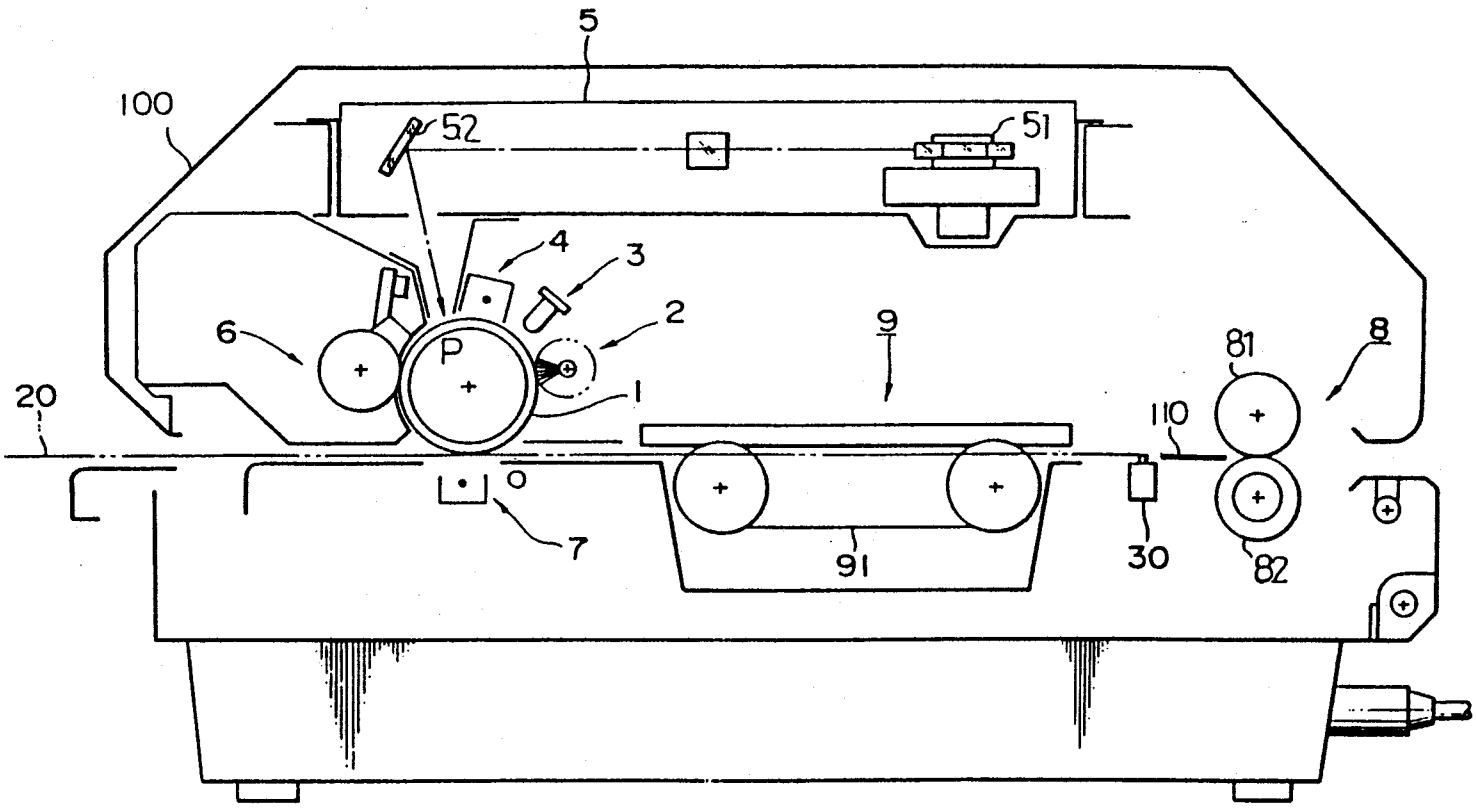
FIG. 1A is a schematic structural diagram of a laser beam printer as one embodiment of a printing device according to the present invention.

Referring to the drawings, an embodiment of the present invention will subsequently be described hereinafter.

FIG. 1A is a schematic structural drawing of a laser beam printer representing one embodiment of an electrophotographic printer using continuous-form recording sheet according to the present invention. FIG. 1C is a block diagram of a controlling system for controlling the printer of FIG. 1A.

The laser beam printer shown in FIG. 1A is designed to form images or printing data, received from a computer or the like, onto a recording medium such as fan-folded sheet 20 which is in the form of a continuous-form sheet. The printer uses the so-called electrophotographic method.

A photoconductive drum 1 is driven to rotate by a main motor, not shown, at a predetermined peripheral speed. A toner cleaning unit 2, a charge removing unit 3, a charging unit 4, a scanning optical system 5 (including a light source 51 and a mirror 52 for introducing a laser beam onto the photoconductive drum 1), a developing unit 6, and a transfer unit 7 are successively disposed along the rotating direction of the photoconductive drum 1.

A left-hand and a right-hand side of a recording sheet feeing path are arranged with the transfer unit 7 therebetween. The transfer unit 7 is disposed substantially under the photoconductive drum 1. A tractor belt 9 is disposed along the recording sheet feeding path at the downstream side of the photoconductive drum 1, whereas a fixing device 8 is disposed along the recording sheet feeding path at the downstream side of the tractor belt 9. In other words, the tractor belt 9 is located between the photoconductive drum 1 and the fixing device 8 in the sheet feeding path. The fixing device 8 is arranged by disposing a pair of fixing rollers, adapted to be brought into contact with each other, between which the fan-folded sheet 20 is fed. The heat roller 81 is arranged to be heated at high temperature by a heating member, for example, a halogen lamp, incorporated within the heat roller 81. The heat roller 81 is arranged to be connected to a rotational drive member, not shown, and driven to rotate at a predetermined peripheral speed substantially equal to the feeding speed of the fan-folded sheet 20. The feeding speed of the tractor belt 9 and the peripheral speed of the photoconductive drum 1 are arranged to be substantially similar to each other so that an undesired tension is not generated on the fan-folded sheet 20 or so that the fan-folded sheet 20 is not undesirably slackened during the feeding operation. In other words, when the tractor belt 9 is driven to rotate faster than the photoconductive drum 1 is driven to rotate, the undesired tension is generated on the fan-folded sheet 20. When the photoconductive drum 1 is driven to rotate faster than the tractor belt 9 is driven to rotate, the fan-folded sheet 20 undesirably slackens.

In this case, the length of the sheet feeding path of the fan-folded sheet 20 from the transfer unit 7 to the fixing device 8 is arranged to be substantially the same as the length corresponding to one page of the fan-folded sheet 20.

Further, a reflection type photosensor 30 as a sheet detector is located between the tractor belt 9 and the fixing device 8.

Figure 1B:
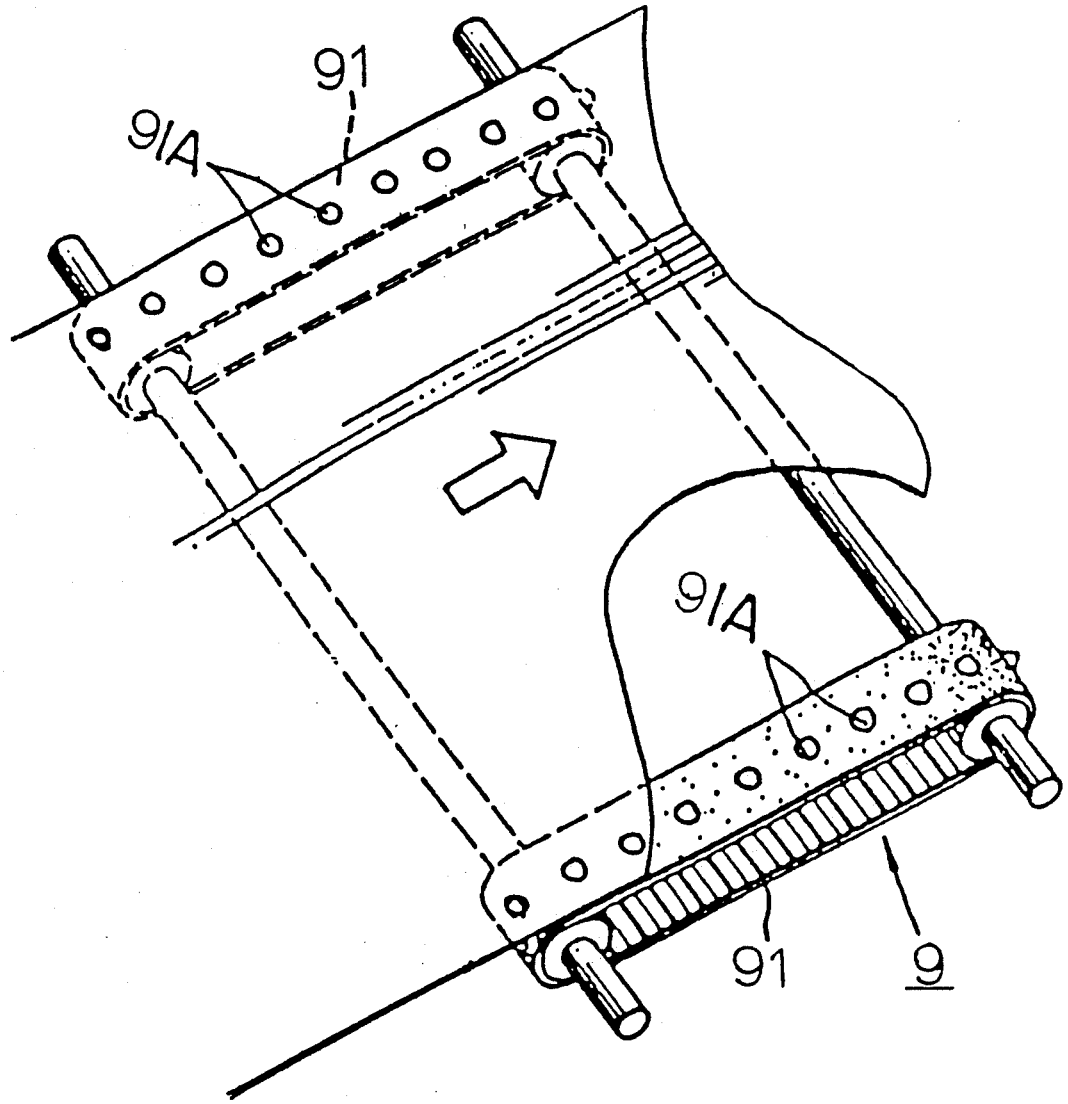
FIG. 1B is a perspective view showing a tractor belt incorporated in the printer of FIG. 1A.
Figure 1C:
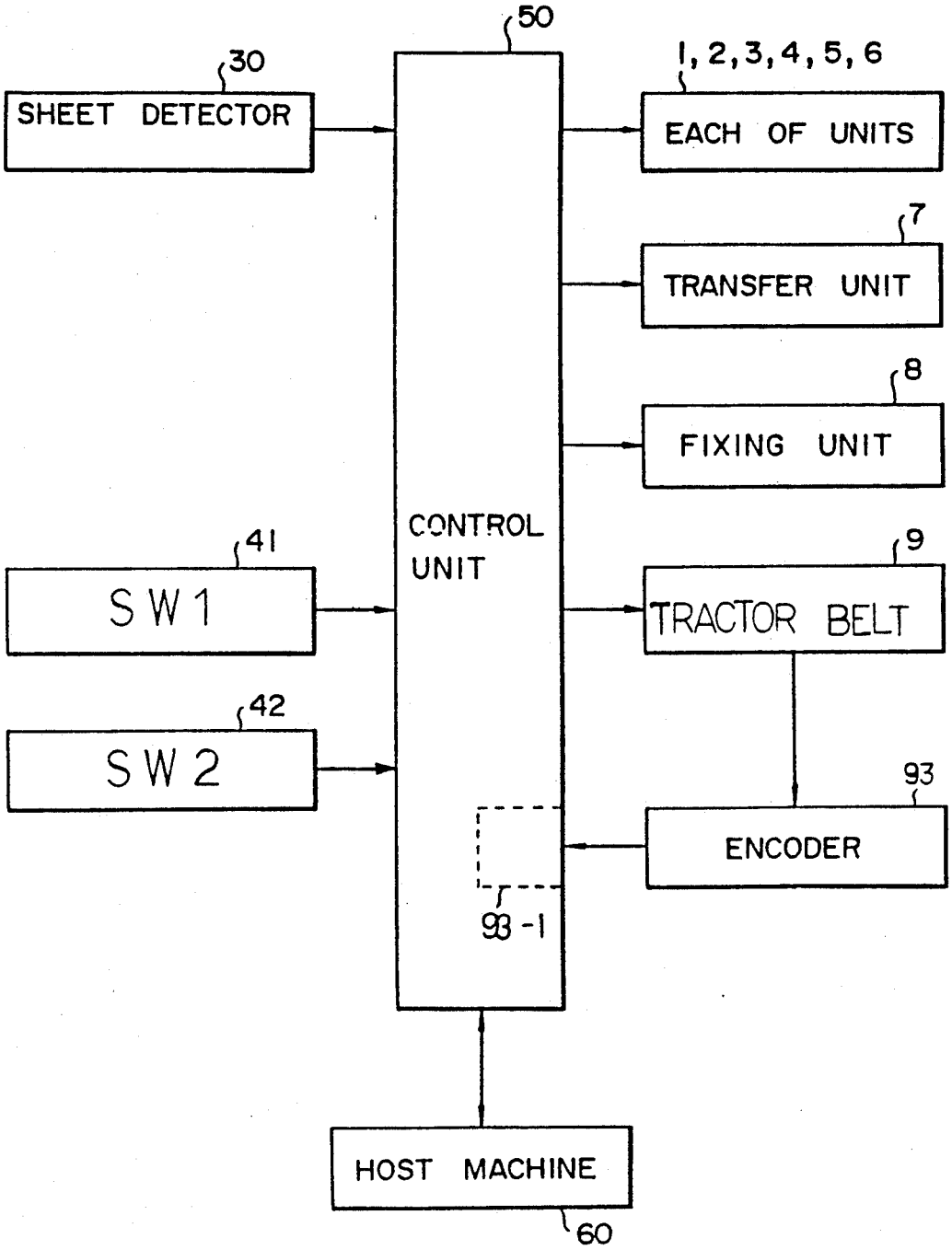
FIG. 1C is a block diagram of a controlling system for controlling the laser beam printer of FIG. 1A.

As shown in FIG. 1B, the tractor belt 9 is composed of two endless belts 91, 91 each provided with projections 91A, 91A to be fitted into respective sprocket holes bored at both side edges of the fan-folded sheet 20. The endless belts 91, 91 are disposed in parallel with each other and the intervals of the projections 91A, 91A are arranged substantially similarly to the intervals of sprocket holes on the fan-folded sheet 20. The fan-folded sheet 20 is fed as the endless belts 91, 91 are driven to rotate. The endless belt 91, 91 are driven by a drive motor, not shown, coupled to a pulley linked with one of the endless belts 91 to revolve in a direction along which the fan-folded sheet 20 is fed. As shown in FIG. 1C, there is provided a control unit 50 for controlling each of the operations executed in the laser beam printer, i.e., the driving operation of the tractor belt 9, the fixing operation executed by means of the fixing device 8, and the operation of the respective processing units by electrophotographic method (including the rotational driving operation of the photoconductive drum 1, the toner cleaning unit 2, the charge removing unit 3, the charging unit 4, the scanning optical system 5, and the developing unit 6). Further, as shown in FIG. 1C, an encoder 93 is coupled to the tractor belt 9 for correctly identifying the amount of feeding of the fan-folded sheet 20 fed by the tractor belt 9. The encoder 93 is arranged so as to generate a pulse train synchronous with the rotation of the tractor belt 9. For example, the encoder 93 is composed of a pair of light receiving elements and a light transmitting element and a disc plate, rotatably provided between the light transmitting and receiving elements in accordance with the rotation of the tractor belt 9 and having a plurality of slits each radially extending from the rotary center. Further, it is arranged to generate a pulse for each receiving operation of the light receiving elements. Therefore an amount of feeding of the fan-folded sheet 20 can be identified based upon the generated pulses. Further, switches 41, 42 are provided on the laser beam printer. The switch 41 is provided for starting a sheet setting process, described later, and the switch 42 is provided for starting the sheet feeding process described later.

In the laser beam printer, a surface of the photoconductive drum 1 is scanned by a laser beam from the scanning optical system 5 in a direction of rotation axis of the photoconductive drum 1. The laser beam is modulated, i.e., ON/OFF operated, in accordance with the image data, which is transmitted from a host machine 60 or the like, relating to the image to be visually formed. The photoconductive drum 1 is rotated during the above scanning operation; therefore, a latent image corresponding to the image to be visually formed is formed on the surface of the photoconductive drum 1. In the transfer unit 7,, the toner image is transferred onto the fan-folded sheet 20 being fed at the speed synchronous with the peripheral speed of the photoconductive drum 1.

Figure 2A:
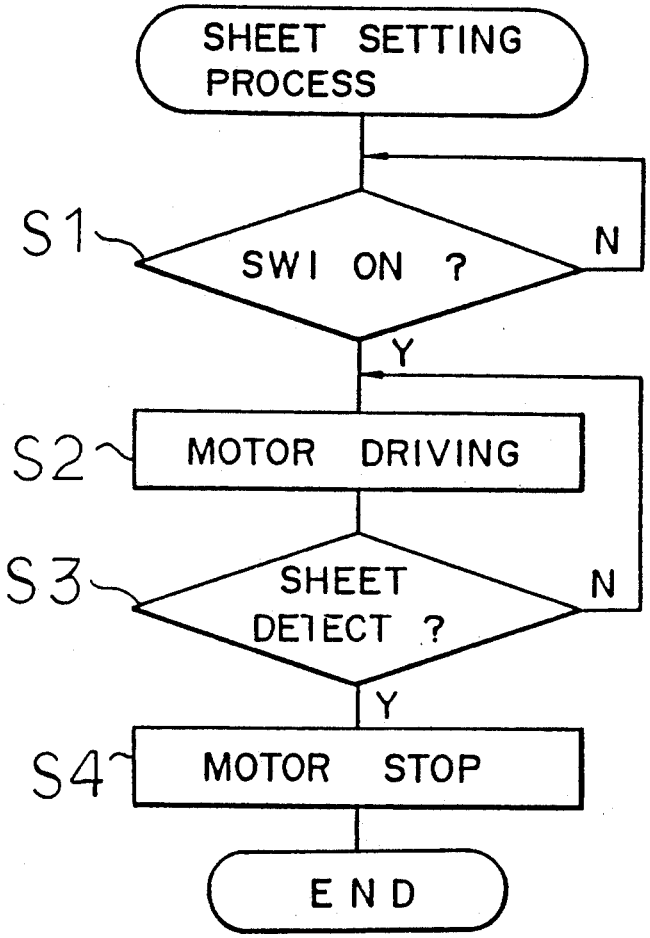
FIG. 2A is a flowchart of a sheet setting process executed by the laser beam printer of FIG. 1A.

Referring to the drawings of FIGS. 2A and 2B, the controlling system for controlling the laser beam printer will be described.

First, in an opening state of an upper cover 100, the sprocket holes of the fan-folded sheet 20 are fitted on the projection 91A of the pair of endless belts 91, 91, i.e., the fan-folded sheet 20 is mounted on the laser beam printer. In step S1, it is examined whether the switch "SW1" is operated or not. When the "SW1" is operated, the tractor belt 9 is driven to rotate so that the fan-folded sheet 20 is forwardly fed in step S2. In step S3, when the detector 30 detects a leading edge of the fan-folded sheet 20, the feeding operation for the fan-folded sheet 20 is ceased in step S4. Then, the leading edge of the fan-folded sheet 20 is stopped before reaching the fixing device 8, as shown in FIG. 1A.

The leading edge of the fan-folded sheet 20 is then prevented from curling by means of the heated heat roller 81. Further, since the length between the transfer unit 7 and the fixing device 8 is arranged to be substantially same as the length of one page of the fan-folded sheet 20, the transferring position of the transfer unit 7 corresponds to a position preceding to the trailing edge of the first page of the fan-folded sheet 20.

Figure 2B:
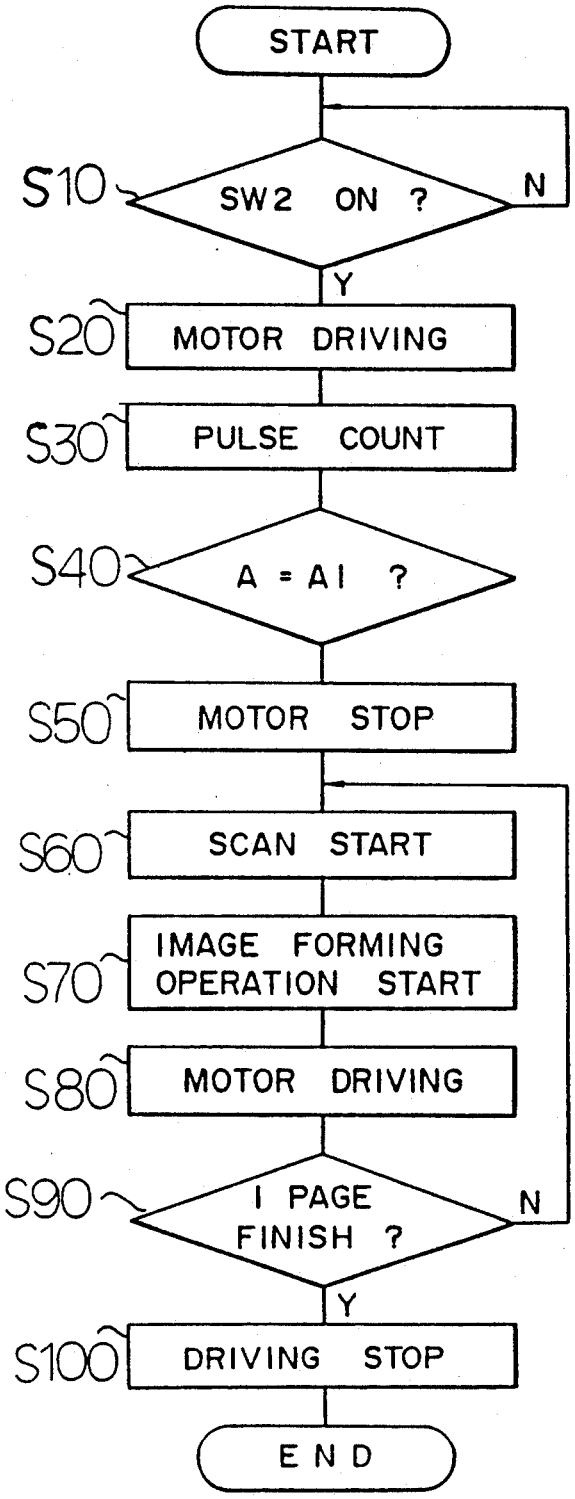
FIG. 2B is a flowchart of a sheet feeding process executed by the laser beam printer of FIG. 1A.

After the above sheet setting process, in step S10, it is examined whether the switch "SW2" is operated or not, as shown in FIG. 2B. When the "SW2" is operated, the fan-folded sheet 20 is driven to be fed in step S20, and simultaneously to count a number of pulses from the encoder 93 by a counter 93-1 in step S30, till the value "A" counted by the counter 93-1 becomes "A1" in step S40, and further, the feeding operation of the fan-folded sheet 20 is stopped in step S50 when the value "A" becomes "A1", i.e., "A=A1". During the feeding operation in step S40, the fan-folded sheet 20 is fed along a predetermined guide member 110, and passed through the pair of rollers 81, 82. In other words, when the feeding operation is stopped at step S50, the leading edge of the fan-folded sheet 20 reaches the fixing device 8 and is nipped by the pair of rollers 81, 82. The value "A1" is set as a value corresponding to a feeding amount of the fan-folded sheet 20 wherein the image information starting position on the second page is located at the position corresponding to the position "P" on the surface of the photoconductive drum 1. In other words, the position "P" on the photoconductive drum 1 will be accurately contacted with the image formation starting position of the second page of the fan-folded sheet 20 as the photoconductive drum 1 is rotated with the feeding operation of the fan-folded sheet 20.

Further, in step S60, the scanning operation of the surface of the photoconductive drum 1 by the scanning operation system 5 is started, and the photoconductive drum 1 is started to be rotated in step S70 and further, in step S80, the fan-folded sheet 20 is driven to be fed. In other words, in steps S60 through S80, the photoconductive drum 1 is rotated and the fan-folded sheet 20 is fed for respectively forming the latent image on the surface of the photoconductive drum 1, and transferring the image corresponding to the latent image on the fan-folded sheet 20.

In step S90, it is examined whether the image transferring operation for one page is finished or not. When the transferring operation for the one page is finished, the driving operations for each of the units are all stopped.

It may be considered that each of the units are stopped to be driven after the image forming operations for all of the data is finished irrespective of the number of the pages.

As described above, with a laser beam printer using a continuous-form recording sheet according to the present invention it becomes possible to prevent more than one page of recording sheet from being wasted.

What is claimed is:

1. A printing device operable in one of a sheet setting mode and an image forming mode, said printing device employing a continuous-form recording sheet on which an image is to be formed, said printing device comprising:

feeding means for feeding the continuous-form recording sheet along a predetermined feeding path; and stopping means, operable during said sheet setting mode, for stopping a feeding operation by said feeding means before a leading edge of the continuous-form recording sheet reaches a fixing unit located in said predetermined feeding path, said stopping means comprising detecting means provided at an upstream side of said fixing unit, for detecting a presence of the continuous-form recording sheet and controlling means for controlling said feeding means to not feed the continuous-form recording sheet when said presence is detected by said detecting means, whereby the feeding operation by said feeding means is stopped when the leading edge of the continuous-form recording sheet reaches a position at which said detecting means is located.

2. The printing device according to claim 1, further comprising means for causing said feeding means to further feed said continuous-form recording sheet past said position only when said printing device is in said image forming mode.

3. A printing device for printing images which is capable of feeding a continuous-form recording sheet and forming images on the continuous-form recording sheet, the continuous-form recording sheet having a leading edge, said printing device comprising:

means for activating one of a sheet setting mode during which the continuous-form recording sheet is loaded into said printing device, and an image forming mode during which the loaded continuous-form recording sheet is continuously fed along a predetermined feeding path;

a forming device for forming an image on said continuous-form recording sheet;

a feeding device for feeding said continuous-form recording sheet along the predetermined feeding path;

a fixing device for fixing the image formed by said forming device on said continuous-form recording sheet;

detecting means for detecting when said leading edge reaches a predetermined location along the predetermined feeding path, said predetermined location being located at an upstream side of said fixing device, wherein said predetermined location is adjacent said fixing device at a location along the predetermined feeding path between said feeding device and said fixing device; and control means for stopping said feeding device from feeding said continuous-form recording sheet before said leading edge reaches said fixing device, when said sheet setting mode is chosen by said means for activating.

4. The printing device according to claim 3, wherein said detecting means comprises a sensor located at said predetermined location.

5. The printing device according to claim 3, wherein said control means stops said feeding device from feeding said continuous-form recording sheet when said leading edge reaches said predetermined location.

6. The printing device according to claim 3, wherein said means for activating comprises a first switch for starting said sheet setting mode, and a second switch for starting said image forming mode.

7. The printing device according to claim 6, wherein when said first switch is on, said control means is activated, and when said first switch is off, said control means is deactivated.

8. The printing device according to claim 3, wherein said continuous-form recording sheet has a plurality of printing pages on which an image is to be formed, each of said pages being designated by a plurality of transverse perforations provided on said continuous-form recording sheet at predetermined spatial intervals along a longitudinal direction of the sheet.

9. The printing device according to claim 8, wherein a spatial interval between said forming device and said fixing device is substantially the same as a longitudinal length of one page of said continuous-form recording sheet.

10. The printing device according to claim 3, wherein said feeding device comprises a tractor belt including a pair of endless belts respectively having a plurality of projections arranged to be fitted into sprocket holes which are located on side edges of said continuous-form recording sheet.

11. The printing device according to claim 3, wherein said forming device comprises a photoconductive drum having a circumferential surface on which a latent image corresponding to a desired image is formed, said circumferential surface being arranged to have toner adhered thereon in accordance with said latent image and arranged to be contacted with said continuous-form recording sheet for transferring the toner image onto said continuous-form recording sheet.

12. The printing device according to claim 3, wherein said fixing device comprises a pair of rollers, adapted to be brought into contact with each other, between which said continuous-form recording sheet is fed, one of said pair of rollers being arranged to be heated at a predetermined temperature.

13. The printing device according to claim 3, further comprising another controlling means for controlling, during said image forming mode, said feeding device to feed said continuous-form recording sheet for a predetermined amount.

14. The printing device according to claim 13, wherein said another controlling means comprises a pulse generating device for generating pulses in accordance with feeding of said continuous-form recording sheet by said feeding device and a counting device for counting a number of pulses generated by said pulse generating device.

15. The printing device according to claim 3, wherein said feeding device is located at a downstream side of said forming device along said predetermined feeding path.

16. A printing device for printing images which is capable of feeding a continuous-form recording sheet which has a leading edge, said printing device comprising:

means for activating one of a sheet setting mode during which the continuous-form recording sheet is loaded into said printing device, and an image forming mode during which the loaded continuous-form recording sheet is continuously fed along a predetermined feeding path;

a feeding device for feeding said continuous-form recording sheet along the predetermined feeding path;

a fixing device for fixing an image formed by a forming device on said continuous-form recording sheet;

detecting means for detecting when said leading edge reaches a predetermined location along the predetermined feeding path, said predetermined location being located at an upstream side of said fixing device, and wherein said predetermined location is adjacent said fixing device at a location along the predetermined feeding path between said feeding device and said fixing device; and control means for stopping said feeding device from feeding said continuous-form recording sheet before said leading edge reaches said fixing device, when said sheet setting mode is chosen by said means for activating.

17. The printing device according to claim 16, wherein said detecting means comprises a sensor located at said predetermined location.

18. The printing device according to claim 16, wherein said control means stops said feeding device from feeding said continuous-form recording sheet when said leading edge reaches said predetermined location.

19. The printing device according to claim 16, wherein said means for activating comprises a first switch for starting said sheet setting mode, and a second switch for starting said image forming mode.

20. The printing device according to claim 19, wherein when said first switch is on, said control means is activated, and when said first switch is off, said control means is deactivated.

21. The printing device according to claim 16, wherein said continuous-form recording sheet has a plurality of printing pages on which an image is to be formed, each of said pages being designated by a plurality of transverse perforations provided on said continuous-form recording sheet at predetermined spatial intervals along a longitudinal direction of the sheet.

22. A printing device for printing images which is capable of feeding a continuous-form recording sheet and forming images on the continuous-form recording sheet, the continuous-form recording sheet having a leading edge, said printing device comprising:

means for activating one of a sheet setting mode during which the continuous-form recording sheet is loaded into said printing device, and an image forming mode during which the loaded continuous-form recording sheet is continuously fed along a predetermined feeding path;

a forming device for forming an image on said continuous-form recording sheet;

a feeding device for feeding said continuous-form recording sheet along the predetermined feeding path, wherein said feeding device is located at a downstream side of said forming device along said predetermined feeding path;

a fixing device for fixing the image formed by said forming device on said continuous-form recording sheet;

detecting means for detecting when said leading edge reaches a predetermined location along the predetermined feeding path, said predetermined location being located at an upstream side of said fixing device; and control means for stopping said feeding device from feeding said continuous-form recording sheet before said leading edge reaches said fixing device, when said sheet setting mode is chosen by said means for activating.

23. A printing device for printing images which is capable of feeding a continuous-form recording sheet and forming images on the continuous-form recording sheet, the continuous-form recording sheet having a leading edge and a plurality of printing pages on which an image is to be formed, each of said pages being designated by a plurality of transverse perforations provided on said continuous-form recording sheet at predetermined spatial intervals along a longitudinal direction of the sheet, said printing device comprising:

means for activating one of a sheet setting mode during which the continuous-form recording sheet is loaded into said printing device, and an image forming mode during which the loaded continuous-form recording sheet is continuously fed along a predetermined feeding path;

a forming device for forming an image on said continuous-form recording sheet;

a feeding device for feeding said continuous-form recording sheet along the predetermined feeding path;

a fixing device for fixing the image formed by said forming device on said continuous-form recording sheet, wherein a spatial interval between said forming device and said fixing device is substantially the same as the longitudinal length of one page of said continuous-form recording sheet;

detecting means for detecting when said leading edge reaches a predetermined location along the predetermined feeding path, said predetermined location being located at an upstream side of said fixing device; and control means for stopping said feeding device from feeding said continuous-form recording sheet before said leading edge reaches said fixing device, when said sheet setting mode is chosen by said means for activating.

* * * * *

UNITED STATES PATENT AND TRADEMARK OFFICE

CERTIFICATE OF CORRECTION

PATENT NO. : 5,210,583

DATED : May 11, 1993

INVENTOR(S) : Y. MONMA

It is certified that error appears in the above-indentified patent and that said Letters Patent is hereby corrected as shown below:

On the cover, item [73], Assignee, lines 1-2, change "Asahi, Kogaku, Kogyo, Kabushiki, Kaisha" to ---Asahi Kogaku Kogyo Kabushiki Kaisha---.

Signed and Sealed this

Twenty-fifth Day of June, 1996

Bruce Lehman

*Attest:*

BRUCE LEHMAN

*Attesting Officer*

*Commissioner of Patents and Trademarks*